US008761641B2

(12) United States Patent
Tanaka et al.

(10) Patent No.: US 8,761,641 B2
(45) Date of Patent: Jun. 24, 2014

(54) IMAGE FORMING APPARATUS HAVING CHARGING UNIT SUPPORT

(75) Inventors: Arichika Tanaka, Kanagawa (JP); Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 136 days.

(21) Appl. No.: 13/368,980

(22) Filed: Feb. 8, 2012

(65) Prior Publication Data

US 2013/0078000 A1 Mar. 28, 2013

(30) Foreign Application Priority Data

Sep. 28, 2011 (JP) ..... 2011-212628

(51) Int. Cl.
*G03G 15/02* (2006.01)

(52) U.S. Cl.
USPC ..... 399/171; 399/116

(58) Field of Classification Search
USPC ..... 399/115, 171
See application file for complete search history.

(56) References Cited

U.S. PATENT DOCUMENTS 4,466,729 A * 8/1984 Iwata ..... 399/115
4,627,701 A * 12/1986 Onoda et al. ..... 399/170
5,313,255 A 5/1994 Taniguchi et al.
6,091,917 A 7/2000 Aoki
6,823,157 B2 * 11/2004 Foltz ..... 399/171
2008/0253805 A1 10/2008 Yoshino
2010/0239320 A1 * 9/2010 Eder et al. ..... 399/170

FOREIGN PATENT DOCUMENTS

JP 64-65573 A 3/1989
JP 2008-262114 A 10/2008

OTHER PUBLICATIONS

Australian Office Action mailed Nov. 23, 2012 for corresponding Australian Patent Application No. 2012201066.

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

An image forming apparatus has a latent image forming portion that includes a latent image carrier having a cylindrical shape, and a supporting member disposed at both ends of the latent image carrier and rotatably supporting the latent image carrier, a charging unit that includes a discharge electrode supplying electric charge to the latent image carrier, and a grid electrode having a shape curved around the latent image carrier, a first supporting portion that supports the curved grid electrode from the latent image carrier side, a second supporting portion that supports the curved grid electrode from the discharge electrode side, and a pinching unit that pinches the grid electrode between the first supporting portion and the second supporting portion in a contact state.

8 Claims, 12 Drawing Sheets

IMAGE FORMING APPARATUS HAVING CHARGING UNIT SUPPORT

CROSS-REFERENCE TO RELATED APPLICATIONS

This application is based on and claims priority under 35 USC 119 from Japanese Patent Application No. 2011-212628 filed Sep. 28, 2011.

BACKGROUND (i) Technical Field

The present invention relates to an image forming apparatus.

(ii) Related Art

In an image forming apparatus where a latent image is formed on an image supporting body, and a toner image is formed by supplying toner to the latent image, the outer circumferential surface of the image supporting body is charged by a charging unit.

This charging unit includes a charge wire (an example of the discharge electrode) supplying electric charge to an image supporting body and a grid electrode (an example of the control electrode) controlling a potential of the image supporting body. In addition, in order to increase a charging speed of the image supporting body, there are cases where the grid electrode has a curved shape so as to be curved along the image supporting body.

SUMMARY

According to an aspect of the invention, there is provided an image forming apparatus having a latent image forming portion that includes a latent image carrier having a cylindrical shape, and a supporting member disposed at both ends of the latent image carrier and rotatably supporting the latent image carrier; a charging unit that includes a discharge electrode supplying electric charge to the latent image carrier due to discharge, and a grid electrode disposed between the discharge electrode and the latent image carrier, having a shape curved around the latent image carrier, and controlling a potential of the latent image carrier, and that charges an outer circumferential surface of the latent image carrier with a preset potential; a first supporting portion that is disposed further on outside than the supporting member and supports the curved grid electrode from the latent image carrier side; a second supporting portion that is provided at positions opposite to the first supporting portion in the charging unit and supports the curved grid electrode from the discharge electrode side; and a pinching unit that biases the charging unit toward the latent image forming portion so as to pinch the grid electrode between the first supporting portion and the second supporting portion in a contact state.

BRIEF DESCRIPTION OF THE DRAWINGS

Exemplary embodiments of the present invention will be described in detail based on the following figures, wherein.

DETAILED DESCRIPTION

Figure 1:
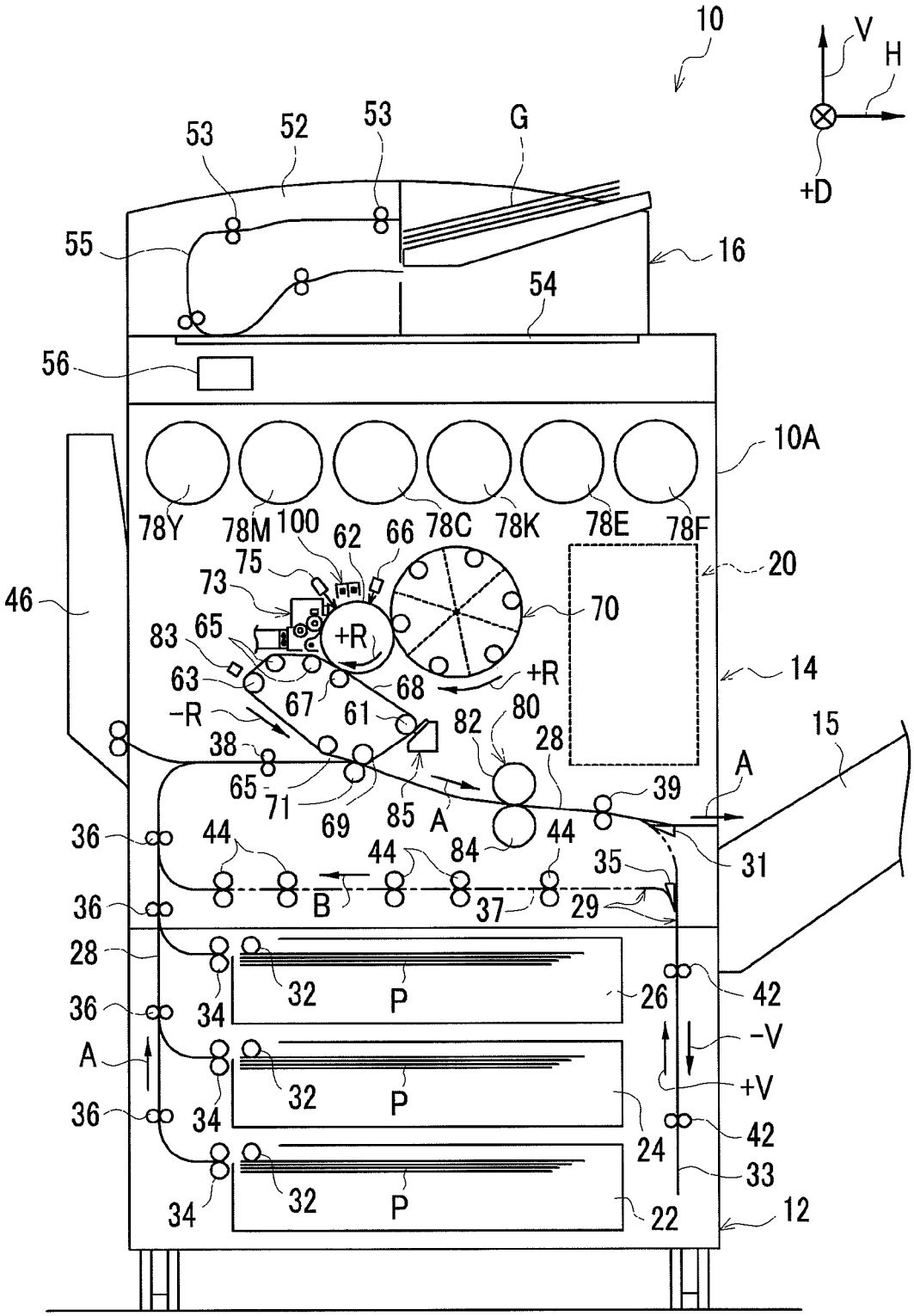
FIG. 1 is a diagram illustrating an overall image forming apparatus according to an exemplary embodiment of the invention.

Hereinafter, exemplary embodiments of the invention will be described in detail with reference to the accompanying drawings. In addition, in the drawings for describing the exemplary embodiments, the same constituent elements are basically given the same reference numerals, and repeated description will be omitted.

FIG. 1 shows an image forming apparatus 10 according to an exemplary embodiment of the invention.

The shown image forming apparatus 10 includes, from the lower side to the upper side in the vertical direction (arrow V direction), a paper accommodating portion 12 which accommodates recording paper P, an image forming portion 14 which is provided on the paper accommodating portion 12 and forms an image on the recording paper P supplied from the paper accommodating portion 12, a document reading portion 16 which is provided on the image forming portion 14 and reads a read document G, and a control portion 20 which is provided inside the image forming portion 14 and controls operations of the respective portions of the image forming apparatus 10. Further, in the following description, the up and down direction of an apparatus main body 10A of the image forming apparatus 10 is indicated by an arrow V direction, the left and right direction (horizontal) is indicated by an arrow H direction, and the depth direction (horizontal) is indicated by an arrow +D direction.

The paper accommodating portion 12 is provided with a first accommodating portion 22, a second accommodating portion 24, and a third accommodating portion 26 which accommodate sheets of recording paper P having different sizes as an example of the recording medium. Each of the first accommodating portion 22, the second accommodating portion 24, and the third accommodating portion 26 is provided with a delivery roller 32 which delivers the accommodated recording paper P to a transport path 28 installed in the image forming apparatus 10. A pair of transport rollers 34 and a pair of transport rollers 36 which transport a sheet of recording paper P are provided further on the downstream side on the transport path 28 than the delivery roller 32. Alignment rollers 38 which temporarily stop the recording paper P and deliver the recording paper P to a secondary transfer position described later at a determined timing are provided further on the downstream side in the transport path 28 than the transport rollers 36 in the transport direction of the recording paper P.

The upstream side part of the transport path 28 is provided in a straight line form from the left side of the paper accommodating portion 12 to the left lower part of the image forming portion 14 in the arrow V direction in the front view of the image forming apparatus 10. Further, the downstream side part of the transport path 28 is provided from the left lower part of the image forming portion 14 to a paper output portion 15 which is installed at the right side surface of the image forming portion 14. In addition, the transport path 28 is connected to a duplex transport path 29 on which the recording paper P is transported and reversed such that images are formed on both sides of the recording paper P.

The duplex transport path 29 is provided with a first switching member 31 which switches between the transport path 28 and the duplex transport path 29, a reversing portion 33 which is provided in a straight line shape in the arrow −V direction (downward in the figure) from the right lower part of the image forming portion 14 to the right side of the paper accommodating portion 12, a transport portion 37 which the rear end of the recording paper P transported to the reversing portion 33 enters and where the recording paper P is transported in the arrow H direction (leftward in the figure), and a second switching member 35 which switches between the reversing portion 33 and the transport portion 37, in the front view of the image forming apparatus 10. In addition, the reversing portion 33 is provided with plural pairs of transport rollers 42 at intervals, and the transport portion 37 is provided with plural pairs of transport rollers 44 at intervals.

The first switching member 31 is a member having a triangular prism shape, and a front end thereof is moved to one of the transport path 28 or the duplex transport path 29 by a driver (not shown), thereby switching a transport direction of the recording paper P. In the same manner, the second switching member 35 is a member having a triangular prism shape in the front view, and a front end thereof is moved to one of the reversing portion 33 or the transport portion 37 by a driver (not shown), thereby switching the transport direction of the recording paper P. In addition, the downstream side end of the transport portion 37 is connected to the front side of the transport rollers 36 which are located at the upstream side part of the transport path 28 by a guide member (not shown). Further, a folding type manual paper feeding portion 46 is provided at the left side surface of the image forming portion 14, and a connection is made from the manual paper feeding portion 46 to the front of the alignment rollers 38 on the transport path 28.

The document reading portion 16 is provided with a document transport device 52 which automatically transports a read document G by one sheet, a platen glass 54 which is disposed on the lower side of the document transport device 52 and places a read document G thereon, and a document reading device 56 which reads the read document G transported by the document transport device 52 or the read document G placed on the platen glass 54.

The document transport device 52 has an automatic transport path 55 at which plural pairs of transport rollers 53 are disposed, and a part of the automatic transport path 55 is disposed such that the read document G passes on the platen glass 54. In addition, the document reading device 56 reads the read document G transported by the document transport device 52 in a state of being stopped at the left end of the platen glass 54, or reads the read document G placed on the platen glass 54 while being moved in the arrow H direction.

On the other hand, the image forming portion 14 is provided with a cylindrical photoreceptor 62 as an example of the latent image carrier at the center of the apparatus main body 10A. The photoreceptor 62 is rotated in the arrow +R direction (shown clockwise direction) by a driver (not shown), and supports an electrostatic latent image which is formed through light irradiation. In addition, a scorotron type charging unit 100 as an example of the charging unit which charges the surface of the photoreceptor 62 is provided on the upper side of the photoreceptor 62 and at a position facing the outer circumferential surface of the photoreceptor 62. Further, details of the charging unit 100 will be described later.

Figure 2:
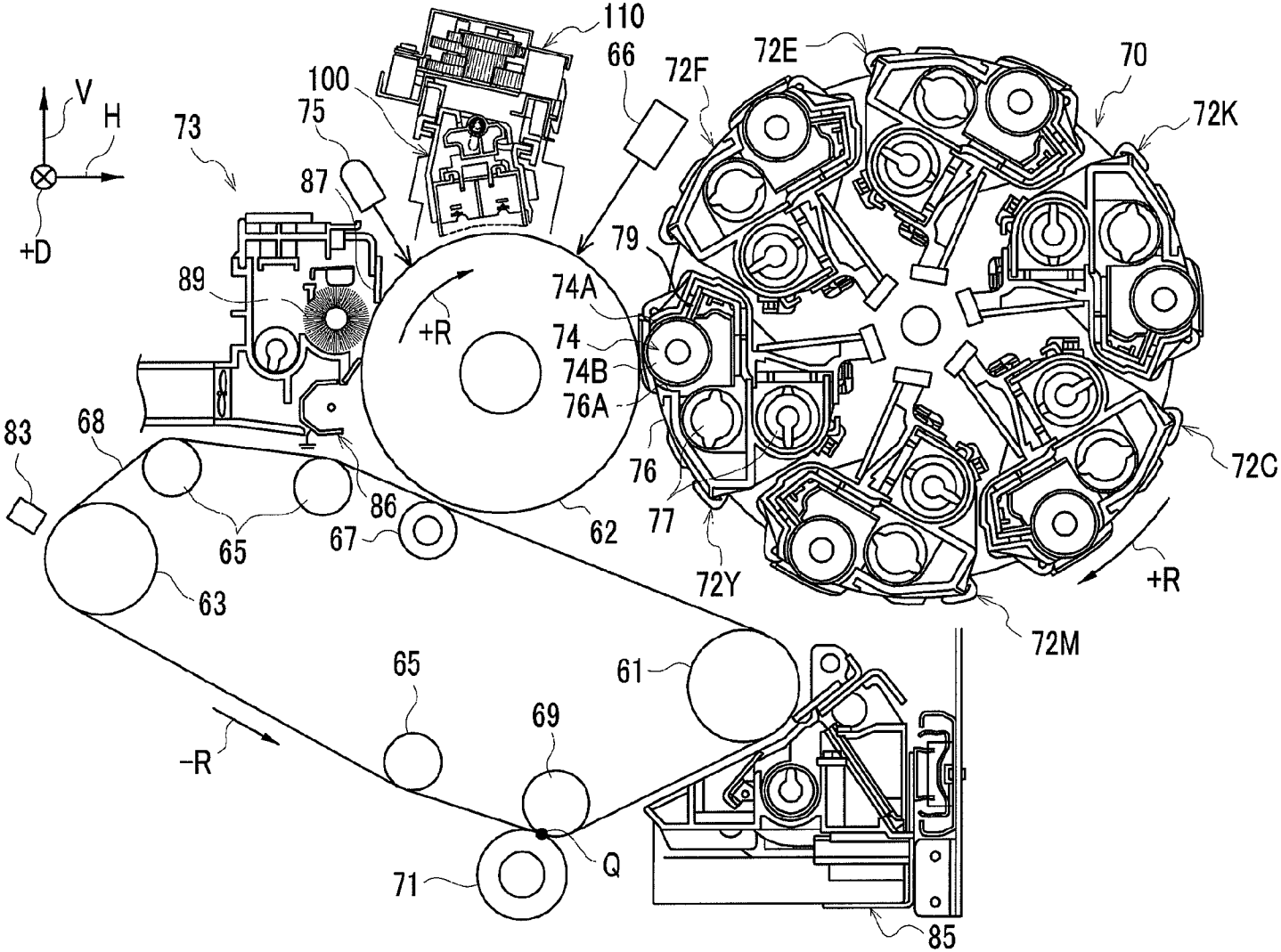
FIG. 2 is a configurational diagram of an image forming unit according to the exemplary embodiment of the invention.

As shown in FIG. 2, an exposure device 66 is provided further on the downstream side in the rotation direction of the photoreceptor 62 than the charging unit 100 and at the position facing the outer circumferential surface of the photoreceptor 62. The exposure device 66 includes LEDs (Light Emitting Diodes), and applies light (exposes) to the outer circumferential surface of the photoreceptor 62 which is charged by the charging unit 100 based on an image signal corresponding to each toner color, thereby forming an electrostatic latent image. Further, the exposure device 66 is not limited to the LED type, and, for example, may scan laser light using a polygon mirror.

A rotational change type development device 70 as an example of the developer which develops the electrostatic latent image formed on the outer circumferential surface of the photoreceptor 62 with set color toner so as to be visualized, is provided further on the downstream side in the rotation direction of the photoreceptor 62 than the part where exposure light is applied by the exposure device 66.

An intermediate transfer belt 68 onto which the toner image formed on the outer circumferential surface of the photoreceptor 62 is transferred is provided further on the downstream side in the rotation direction of the photoreceptor 62 than the development device 70 and on the lower side of the photoreceptor 62. The intermediate transfer belt 68 has an endless shape, and is wound on a driving roller 61 which is driven to be rotated by the control portion 20, a tension giving roller 63 which gives tension to the intermediate transfer belt 68, plural transport rollers 65 which come into contact with the rear surface of the intermediate transfer belt 68 and are rotated to follow the intermediate transfer belt 68, and an auxiliary roller 69 which comes into contact with the rear surface of the intermediate transfer belt 68 and is rotated to follow the intermediate transfer belt 68 at a secondary transfer position described later. In addition, the intermediate transfer belt 68 is circularly moved in the arrow −R direction (shown counterclockwise direction) through the rotation of the driving roller 61.

In addition, a primary transfer roller 67 which primarily transfers the toner image formed on the outer circumferential surface of the photoreceptor 62 onto the intermediate transfer belt 68 is provided at an opposite side to the photoreceptor with the intermediate transfer belt 68 interposed therebetween. The primary transfer roller 67 comes into contact with the rear surface of the intermediate transfer belt 68 at a position which is distant from the movement direction downstream side of the intermediate transfer belt 68 at the position where the photoreceptor 62 comes into contact with the intermediate transfer belt 68. Further, the primary transfer roller 67 is supplied with power from a power supply (not shown), and thereby primarily transfers the toner image on the photoreceptor 62 onto the intermediate transfer belt 68 by a potential difference with the photoreceptor 62 which is connected to the ground.

Moreover, a secondary transfer roller 71 as an example of the transfer portion which secondarily transfers the toner image which is primarily transferred onto the intermediate transfer belt 68 onto the recording paper P is provided at an opposite side to the auxiliary roller 69 with the intermediate transfer belt 68 interposed therebetween. A secondary transfer position (a position Q in FIG. 2) where the toner image is transferred onto the recording paper P is located between the secondary transfer roller 71 and the auxiliary roller 69. The secondary transfer roller 71 comes into contact with the front surface of the intermediate transfer belt 68. In addition, the secondary transfer roller 71 is supplied with power from a power supply (not shown), and thereby secondarily transfers the toner image on the intermediate transfer belt 68 onto the recording paper P by a potential difference with the auxiliary roller 69 which is connected to the ground.

Further, a cleaning device 85 which recovers remaining toner after the secondary transfer of the intermediate transfer belt 68 is provided at an opposite side to the driving roller with the intermediate transfer belt 68 interposed therebetween. In addition, a position detection sensor 83 which detects a preset reference position on the intermediate transfer belt 68 by detecting marks (not shown) attached to the surface of the intermediate transfer belt 68, and outputs a position detection signal which is used as a reference of start timing of an image forming process, is provided at a position opposite to the tension giving roller 63 around the intermediate transfer belt 68.

A cleaning device 73 which cleans remaining toner or the like which is not primarily transferred onto the intermediate transfer belt 68 but remains on the surface of the photoreceptor 62 is provided further on the downstream side in the rotation direction of the photoreceptor 62 than the primary transfer roller 67. The cleaning device 73 has a configuration where remaining toner or the like is recovered by a cleaning blade 87 and a brush roller 89 (refer to FIG. 2) which come into contact with the surface of the photoreceptor 62.

In addition, an electricity removal device 86 (refer to FIG. 2) which removes electricity by applying light to the outer circumferential surface of the photoreceptor 62 is provided at the upstream side of the cleaning device 73 in the rotation direction of the photoreceptor 62 (further on the downstream side than the primary transfer roller 67). The electricity removal device 86 removes electricity by irradiating the outer circumferential surface of the photoreceptor 62 with light before the cleaning device 73 recovers remaining toner or the like so as to reduce attachment force caused by static electricity, thereby increasing a recovery ratio of the remaining toner or the like. Further, an electricity removal lamp 75 which is an electricity remover after recovery of the remaining toner or the like is provided at the downstream side of the cleaning device 73 and at the upstream side of the charging unit 100.

The position where a toner image is secondarily transferred by the secondary transfer roller 71 is set in the course of the transport path 28 described above. Further on the downstream side than the secondary transfer roller 71 in the transport direction (indicated by the arrow A) of the recording paper P of the transport path 28, a fixing device 80 which fixes the toner image onto the recording paper P onto which the toner image is transferred by the secondary transfer roller 71 is provided.

The fixing device 80 includes a heating roller 82 having a heat source which is disposed on the toner image surface side (upper side) of the recording paper P and emits heat by being supplied with power, and a pressing roller 84 which is disposed on the lower side of the heating roller 82 and presses the recording paper P toward the outer circumferential surface of the heating roller 82. In addition, further on the downstream side than the fixing device 80 in the transport direction of the recording paper P of the transport path 28, transport rollers 39 which transport the recording paper P to the paper output portion 15 or the reversing portion 33 are provided.

On the other hand, on the lower side of the document reading device 56 and further on the upper side than the development device 70, toner cartridges 78Y, 78M, 78C, 78K, 78E and 78F which respectively accommodate toner of yellow (Y), magenta (M), cyan (C), black (K), a first special color (E), and a second special color (F) are provided sequentially in the arrow H direction so as to be replaceable. The first special color E and the second special color F are selected from special colors (including transparent) other than yellow, magenta, cyan, and black, or are not selected.

In the development device 70, in a case where the first special color E and the second special color F are selected, an image is formed using the six colors of Y, M, C, K, E, and F, and, in a case where the first special color E and the second special color F are not selected, an image is formed using the four colors of Y, M, C, and K. Further, although, in the exemplary embodiment, as an example, a case where an image is formed using the four colors of Y, M, C, and K and the first special color E and the second special color F are not used is described, an image may be formed using five colors of four colors of Y, M, C, K, and the first special color E or the second special color F as another example.

As shown in FIG. 2, the development device 70 is provided with developer units 72Y, 72M, 72C, 72K, 72E and 72F corresponding to the respective toner colors of yellow (Y), magenta (M), cyan (C), black (K), the first special color (E), and the second special color (F) which are disposed sequentially in the circumferential direction (in this order in the counterclockwise direction). The developer units 72Y, 72M, 72C, 72K, 72E and 72F which perform a development process are changed by being rotated by 60° with respect to the center angle by a motor (not shown) which is a rotation unit, and then face the outer circumferential surface of the photoreceptor 62. In addition, since the developer units 72Y, 72M, 72C, 72K, 72E and 72F have the same configuration, the developer unit 72Y will be described here, and description of the other developer units 72M, 72C, 72K, 72E and 72F will be omitted.

The developer unit 72Y has a case member 76 which is a main body, and the case member 76 is filled with a developer (not shown) including toner and carrier which are supplied from the toner cartridge 78Y (refer to FIG. 1) via a toner supply path (not shown). In addition, the case member 76 has a rectangular opening portion 76A so as to face the outer circumferential surface of the photoreceptor 62, and the opening portion 76A is provided with a development roller 74 of which the outer circumferential surface faces the outer circumferential surface of the photoreceptor 62. Further, a plate-shaped limitation member 79 which limits a layer thickness of the developer is provided at a part close to the opening portion 76A inside the case member 76 along the longitudinal direction of the opening portion 76A.

The development roller 74 includes a cylindrical development sleeve 74A which is rotatably installed and a magnetic member 74B which is constituted by plural magnetic poles fixed inside the development sleeve 74A. The development sleeve 74A is rotated so as to form a magnetic brush of the developer (carrier), and the limitation member 79 limits a layer thickness so as to form a developer layer on the outer circumferential surface of the development sleeve 74A. In addition, the developer layer on the outer circumferential surface of the development sleeve 74A is transported to a position facing the photoreceptor 62, and toner corresponding to a latent image (electrostatic latent image) formed on the outer circumferential surface of the photoreceptor 62 is attached thereto so as to perform development.

Further, two transport rollers 77 which have a spiral shape are rotatably disposed in parallel to each other in the case member 76. When the two transport rollers 77 are rotated, the developer in the case member 76 is circularly transported in the axis direction of the development roller 74 (the longitudinal direction of the developer unit 72Y). In addition, the six development rollers 74 provided in the respective developer units 72Y, 72M, 72C, 72K, 72E and 72F are disposed in the circumferential direction such that the interval with the adjacent development roller 74 forms the center angle 60°. Therefore, the subsequent development roller 74 faces the outer circumferential surface of the photoreceptor 62 by the change of the developer units 72.

Next, an image forming process in the image forming apparatus 10 will be described.

As shown in FIG. 1, when the image forming apparatus 10 is operated, image data for respective colors of yellow (Y), magenta (M), cyan (C), black (K), the first special color (E), and the second special color (F) is sequentially output to the exposure device 66 from an image processing device (not shown) or an external device. At this time, as an example, in the development device 70, the developer unit 72Y (refer to FIG. 2) is rotated and held so as to face the outer circumferential surface of the photoreceptor 62.

Next, in the charging unit 100, the photoreceptor 62 is charged through corona discharge caused by a potential difference between charge wires 102A and 102B (refer to FIG. 3) as an example of the discharge electrode which is supplied with power and the photoreceptor 62 which is connected to the ground. At this time, a bias voltage is applied to a grid electrode 104 (refer to FIG. 3) as an example of the control electrode, and thereby a charge potential (discharge current) of the photoreceptor 62 is controlled so as to be in an allowable range.

Next, light emitted from the exposure device 66 according to the image data exposes the outer circumferential surface (surface) of the photoreceptor 62 charged by the charging unit 100, and an electrostatic latent image corresponding to the yellow image data is formed on the surface of the photoreceptor 62. In addition, the electrostatic latent image formed on the surface of the photoreceptor 62 is developed as a yellow toner image by the developer unit 72Y. Further, the yellow toner image on the surface of the photoreceptor 62 is transferred onto the intermediate transfer belt 68 by the primary transfer roller 67.

Next, as shown in FIG. 2, the development device 70 is rotated by 60° in the arrow +R direction, and thus the developer unit 72M faces the surface of the photoreceptor 62. In addition, the respective processes of the charging, the exposure, and the development are performed, and a magenta toner image on the surface of the photoreceptor 62 is transferred onto the yellow toner image on the intermediate transfer belt 68 by the primary transfer roller 67. In the same manner, cyan (C) and black (K) toner images, and first special color (E) and second special color (F) toner images according to further color setting are sequentially multilayer-transferred onto the intermediate transfer belt 68.

On the other hand, as shown in FIG. 1, the recording paper P which is delivered from the paper accommodating portion 12 and is transported to the transport path 28 is transported to the secondary transfer position (the position Q in FIG. 2) by the alignment rollers 38 in synchronization with the multilayer transfer of the respective toner images onto the intermediate transfer belt 68. In addition, the toner images which are multilayer-transferred onto the intermediate transfer belt 68 are secondarily transferred onto the recording paper P which is transported to the secondary transfer position, by the secondary transfer roller 71.

Next, the recording paper P onto which the toner images are transferred is transported toward the fixing device 80 in the arrow A direction (shown right direction). In addition, in the fixing device 80, the toner images are fixed to the recording paper P through heating and pressing performed by the heating roller 82 and the pressing roller 84. Further, the recording paper P to which the toner images are fixed is output to, for example, the paper output portion 15.

Further, when images are formed on both sides of the recording paper P, an image is fixed to the front surface by the fixing device 80, and then the front end and the rear end of the recording paper P are changed by delivering the recording paper P to the reversing portion 33 along the arrow −V direction and the arrow +V direction. The recording paper P is transported in the arrow B direction (shown left direction) by the duplex transport path 29, and is further transported to the transport path 28, and an image is formed on and is fixed to the rear surface of the recording paper P.

Next, the charging unit 100 and an installation structure of the charging unit 100 will be described.

Figure 3:
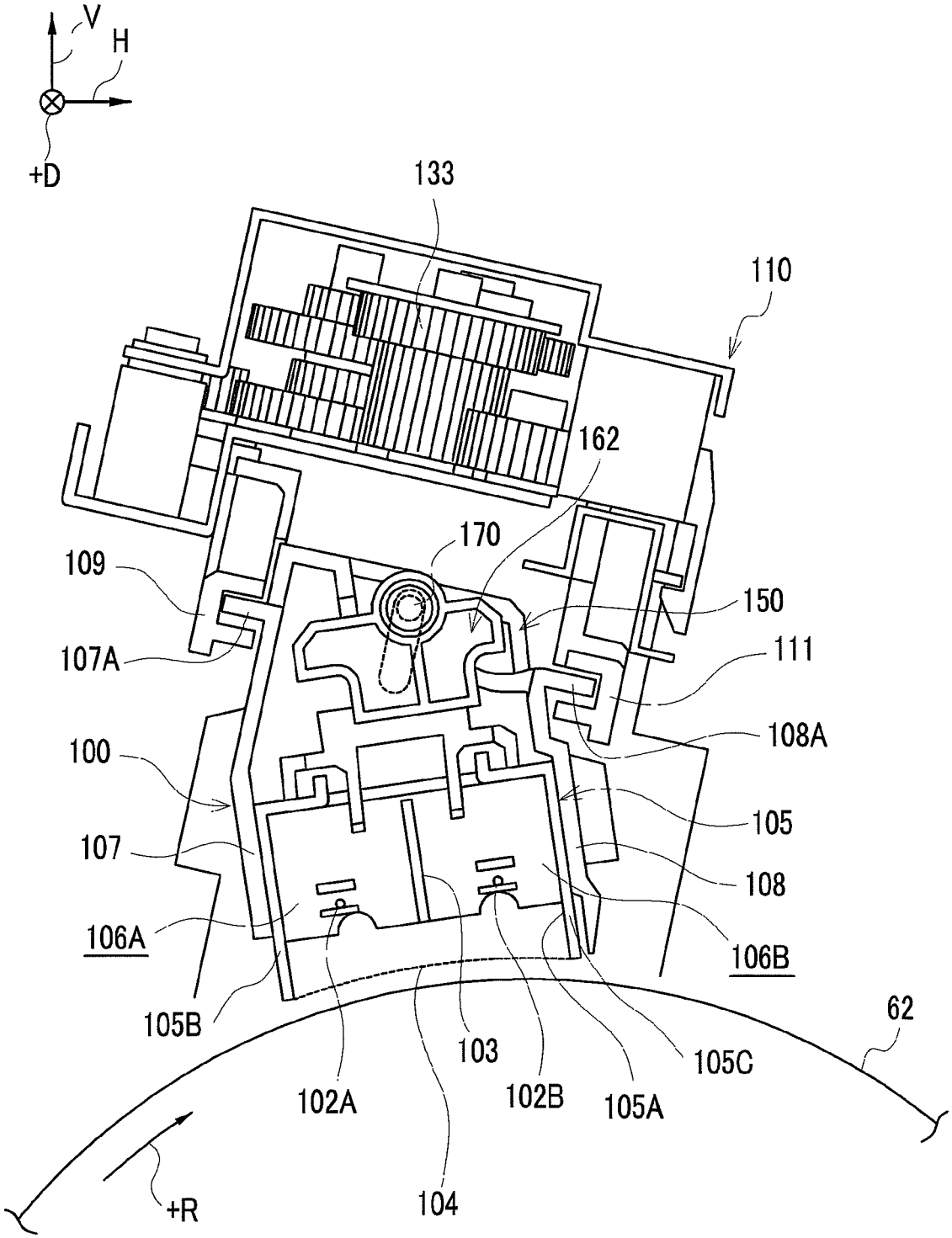
FIG. 3 is a diagram illustrating a configuration of the photoreceptor periphery according to the exemplary embodiment of the invention.

As shown in FIG. 3, the charging unit 100 includes a shield member 105 of which the H-V surface (cross-section) has a U shape. The inside of the shield member 105 is divided into a compartment 106A and a compartment 106B by a partition plate 103 which is disposed upright in the arrow +D direction as a longitudinal direction. Further, in the arrow +R direction, the compartment 106A is disposed at the upstream side, and the compartment 106B is disposed at the downstream side. In addition, as an example, an opening portion 105A of the shield member 105 is disposed to face the outer circumferential surface of the photoreceptor 62.

The charge wire 102A which is an example of the discharge electrode is built-in the compartment 106A in the arrow +D direction as a long axis direction, and, in the same manner, the charge wire 102B which is an example of the discharge electrode is built-in the compartment 106B in the arrow +D direction as the long axis direction. Further, the shield member 105 is provided with the grid electrode 104 which is an example of the control electrode so as to cover the opening portion 105A. The grid electrode 104 is disposed between the charge wires 102A and 102B and the outer circumferential surface of the photoreceptor 62 when viewed from the H-V surface. In addition, details of the grid electrode 104 and a grid cleaning portion 150 cleaning the grid electrode 104 will be described later.

Cover members 107 and 108 which stand upright in the arrow V direction are installed at the outer surfaces of a pair of side walls 105B and 105C of the shield member 105 which are disposed so as to be opposite to each other in the arrow H direction. The upper end of the cover member 107 is bent outwardly (shown left side) in an L shape in the cross-section so as to form a flat plate-shaped guided portion 107A. Further, the upper end of the cover member 108 is bent outwardly (shown right side) in an L shape in the cross-section so as to form a flat plate-shaped guided portion 108A. The guided portions 107A and 108A are guided by guide rails 109 and 111 described later in the arrow +D direction, and are held in the arrow H and V directions (movement is restricted), whereby the charging unit 100 is disposed to face the outer circumferential surface of the photoreceptor 62.

Figure 4:
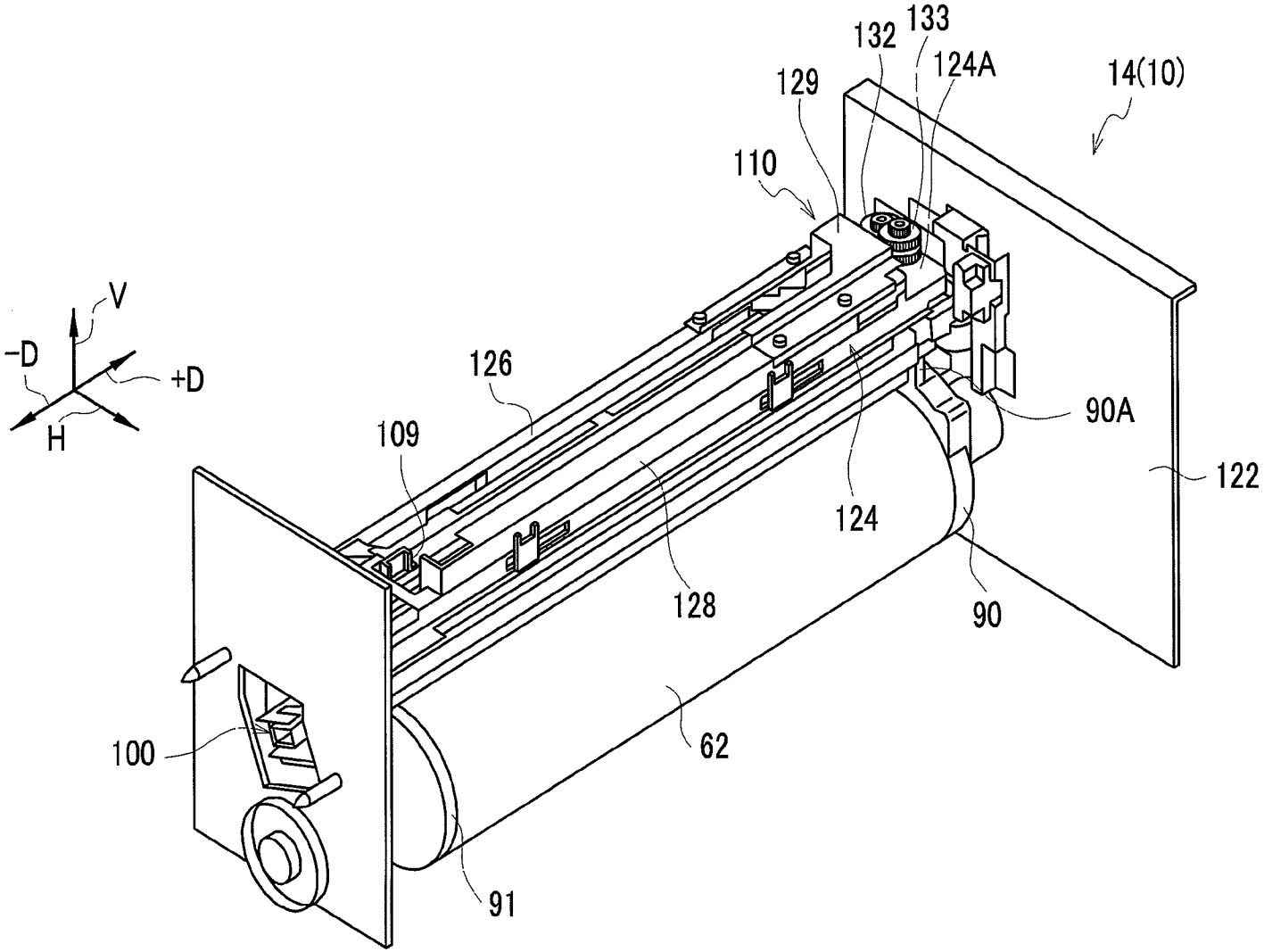
FIG. 4 is a perspective view illustrating a state where the photoreceptor and the charging unit according to the exemplary embodiment of the invention are disposed.

As shown in FIG. 4, housings 90 and 91 which are an example of the supporting member which rotatably supports the photoreceptor 62 are respectively disposed at both ends of the photoreceptor 62 in the axis direction, and the photoreceptor 62 and the housings 90 and 91 constitute a latent image forming portion.

Figure 11:
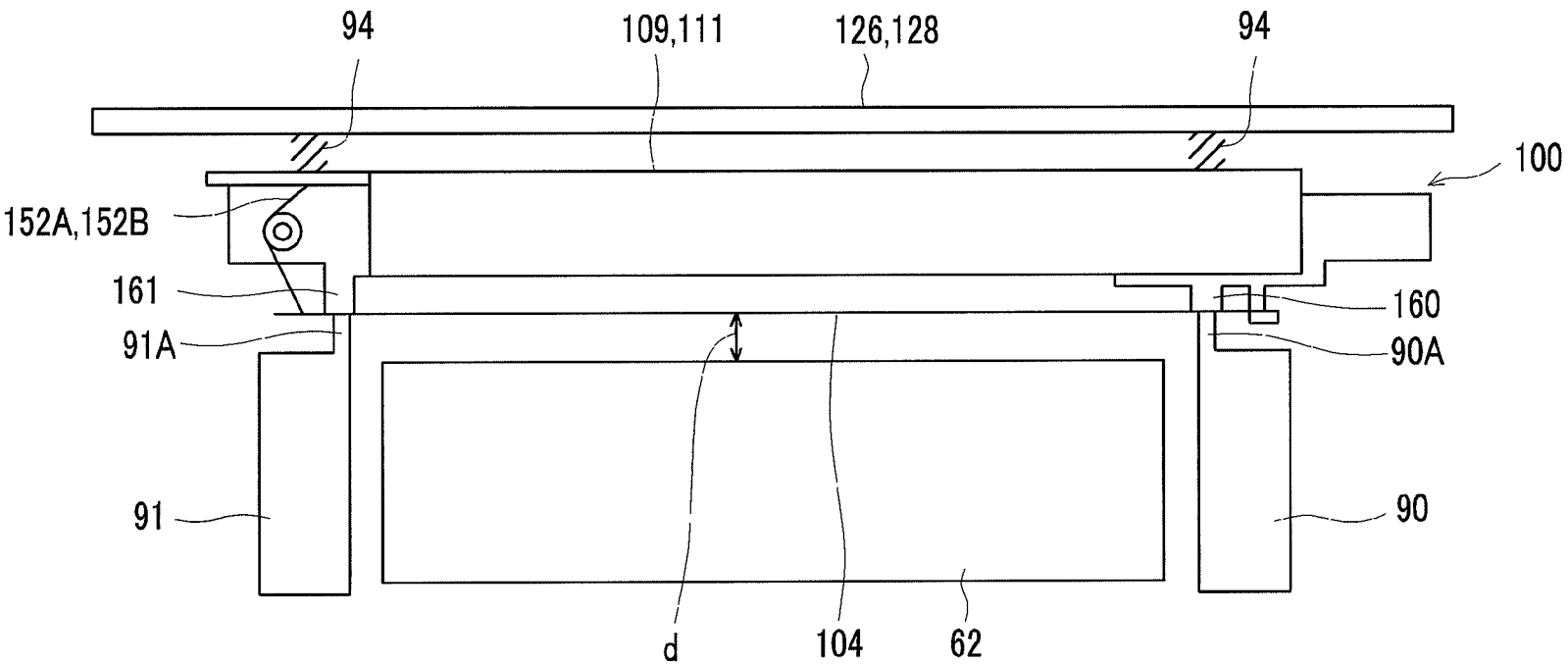
FIG. 11 is a diagram illustrating a case where the charging unit and the photoreceptor according to the exemplary embodiment of the invention are located at a position where charging may be performed.

Ribs 90A and 91A as an example of the first supporting portions are formed at the photoreceptor 62 side of the housings 90 and 91. The upper end surfaces of the ribs 90A and 91A are curved to form convexes upwardly, and the centers of curvature thereof are common to the rotation center of the photoreceptor 62. In addition, the heights of the ribs 90A and 91A are set such that when the grid electrode 104 is supported by the ribs 90A and 91A, the grid electrode 104 and the photoreceptor 62 form a defined gap d (FIG. 11).

Thereby, the curved shape (described later in detail) of the grid electrode 104 is supported from the photoreceptor 62 side at the position where the outer circumferential surface of the photoreceptor 62 may be charged, and the photoreceptor 62 and the grid electrode 104 maintain the gap d (refer to FIG. 11).

Further, as shown in FIG. 4, an installation portion 110 where the charging unit 100 is installed is provided on the upper side of the photoreceptor 62 in the arrow V direction. The installation portion 110 includes a base plate 124, rectangular parallelepiped slide members 126 and 128 (an example of the holding member) which are provided so as to be moved on the base plate 124 in the arrow +D direction (or −D direction), a motor 132 which is a driving source moving the slide members 126 and 128, and guide rails 109 and 111 (refer to FIG. 3) which are vertically moved in the arrow V direction due to the movement of the slide members 126 and 128.

A planarized portion 124A is formed at the other end of the base plate 124, and the motor 132 and a gear train 133 which transmits driving force of the motor 132 to the slide member 128 as described later are provided on the planarized portion 124A.

The slide member 126 is held so as to be moved in the arrow +D direction at the left end upper surface of the base plate 124 when the installation portion 110 is viewed in the arrow +D direction, and the slide member 128 is held so as to be moved in the arrow +D direction at the right end upper surface of the base plate 124 when the installation portion 110 is viewed in the arrow +D direction. In addition, a connection member 129 is fixed to the upper surface of the slide member 126 and the upper surface of the slide member 128 by screws. With the fixing of the connection member 129, the slide member 126 and the slide member 128 may be moved integrally in the arrow +D direction or in the arrow −D direction.

Figure 5A:
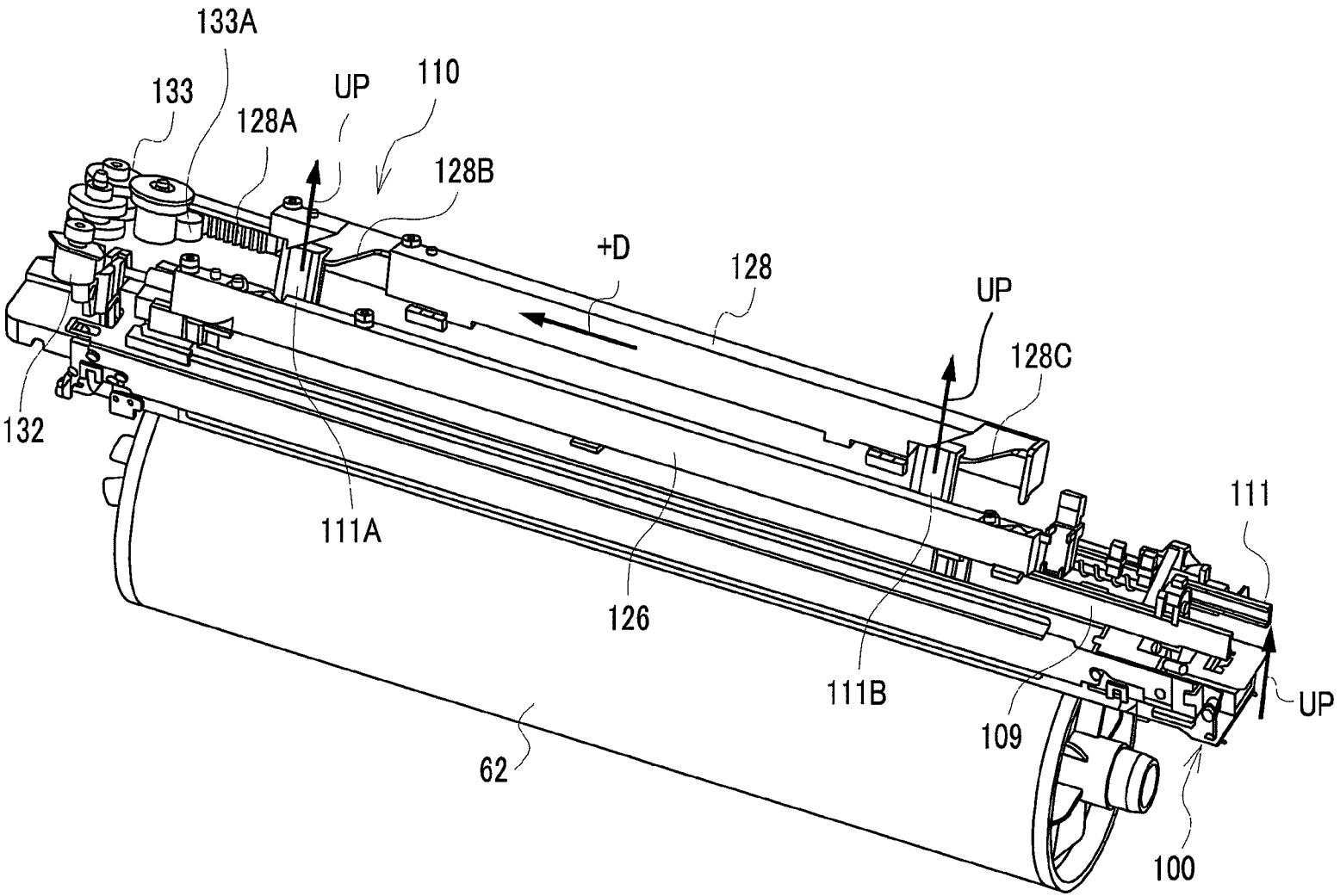
FIG. 5A is a diagram illustrating a state where the charging unit is close to the photoreceptor according to the exemplary embodiment of the invention.
Figure 5B:
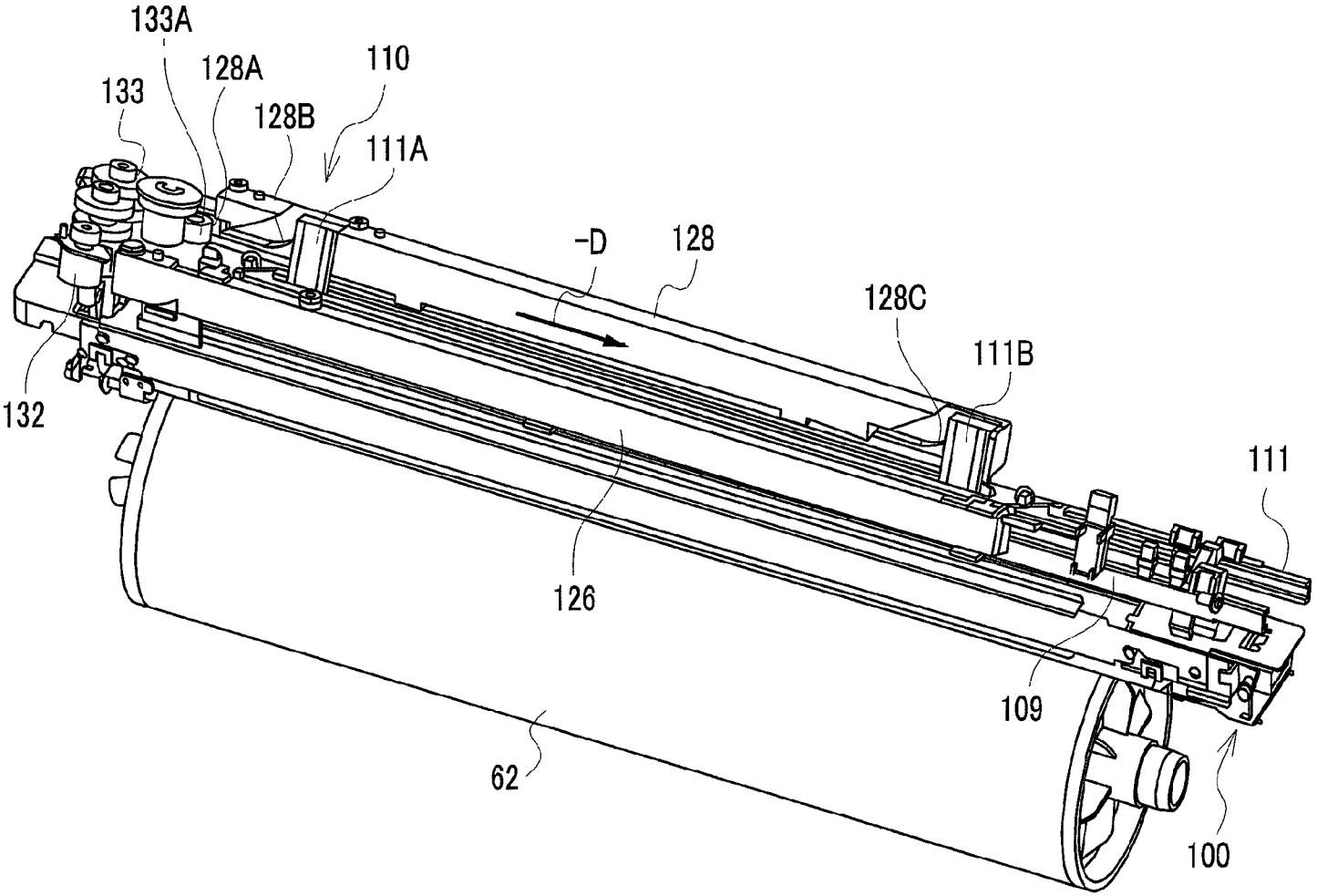
FIG. 5B is a diagram illustrating a state where the charging unit is separated from the photoreceptor according to the exemplary embodiment of the invention.

As shown in FIGS. 5A and 5B, the slide member 128 is provided with a rack portion 128A formed at the gear train 133 side and cam portions 128B and 128C formed at intervals in the arrow +D direction. The rack portion 128A meshes with a pinion 133A which is one of gear wheels constituting the gear train 133, and is thereby moved linearly in the arrow +D direction or the arrow −D direction due to the rotation of the pinion 133A. In addition, each of the cam portions 128B and 128C includes a slant portion which slants downwardly so as to be tilted with respect to the arrow +D direction, and an upper planarized portion and a lower planarized portion which are formed continuously on the upper end and the lower end of the slant portion.

The guide rail 111 which guides the charging unit 100 in the arrow +D direction and holds the charging unit 100 on the photoreceptor 62 is provided on the lower side of the slide member 128. The guide rail 111 is provided with hook portions 111A and 111B at intervals in the arrow +D direction. The hook portions 111A and 111B have a reverse L shape in the cross-section when viewed from the arrow +D direction, and the planarized portions located at the upper end are hooked to the cam portions 128B and 128C of the slide member 128. In addition, the hook portions 111A and 111B are located at the lower end of the cam portions 128B and 128C during image formation.

With such a configuration, when the slide member 128 is moved in the arrow +D direction by the rotation of the pinion 133A, the hook portions 111A and 111B are moved upwardly (the arrow UP direction) along the slant surfaces of the cam portions 128B and 128C, and the guide rail 111 is moved in the arrow UP direction.

Meanwhile, in the same manner as the slide member 128, the slide member 126 is also provided with cam portions (not shown) which slant downwardly so as to be tilted with respect to the arrow +D direction, and hook portions (not shown) installed in the guide rail 109 are hooked to the cam portions. Further, since the slide member 126 is not provided with a rack but is integrally formed with the slide member 128 by the connection member 129 (refer to FIG. 4), the slide member 128 is moved in the arrow +D direction and the slide member 126 is simultaneously moved in the arrow +D direction. Thereby, the hook portions are moved upwardly along the cam portions, and the guide rail 109 is moved in the arrow UP direction.

As such, when the slide members 126 and 128 are moved in the arrow +D direction, the guide rails 109 and 111 are moved in the arrow UP direction, the charging unit 100 held by the guide rails 109 and 111 is moved in the arrow UP direction with respect to the outer circumferential surface of the photoreceptor 62.

Here, as shown in FIG. 5A, the charging unit 100 locates the slide members 126 and 128 in the arrow −D direction with respect to the base plate 124 (refer to FIG. 4) during image formation, and thus the outer circumferential surface of the photoreceptor 62 is held at a position where it maybe charged. Further, when the grid electrode 104 (refer to FIG. 7) described later is cleaned, and the charging unit 100 is added to and deleted from the image forming portion 14 (refer to FIG. 1), if the slide members 126 and 128 are moved in the arrow +D direction with respect to the base plate 124 (refer to FIG. 4), the guide rails 109 and 111 rise. Therefore, as shown in FIG. 5B, the charging unit 100 is held at a position which is further spaced from the photoreceptor 62 than the position where the outer circumferential surface of the photoreceptor 62 is charged. In addition, in FIGS. 5A and 5B, the base plate 124 (refer to FIG. 4) is not shown.

Figure 6:
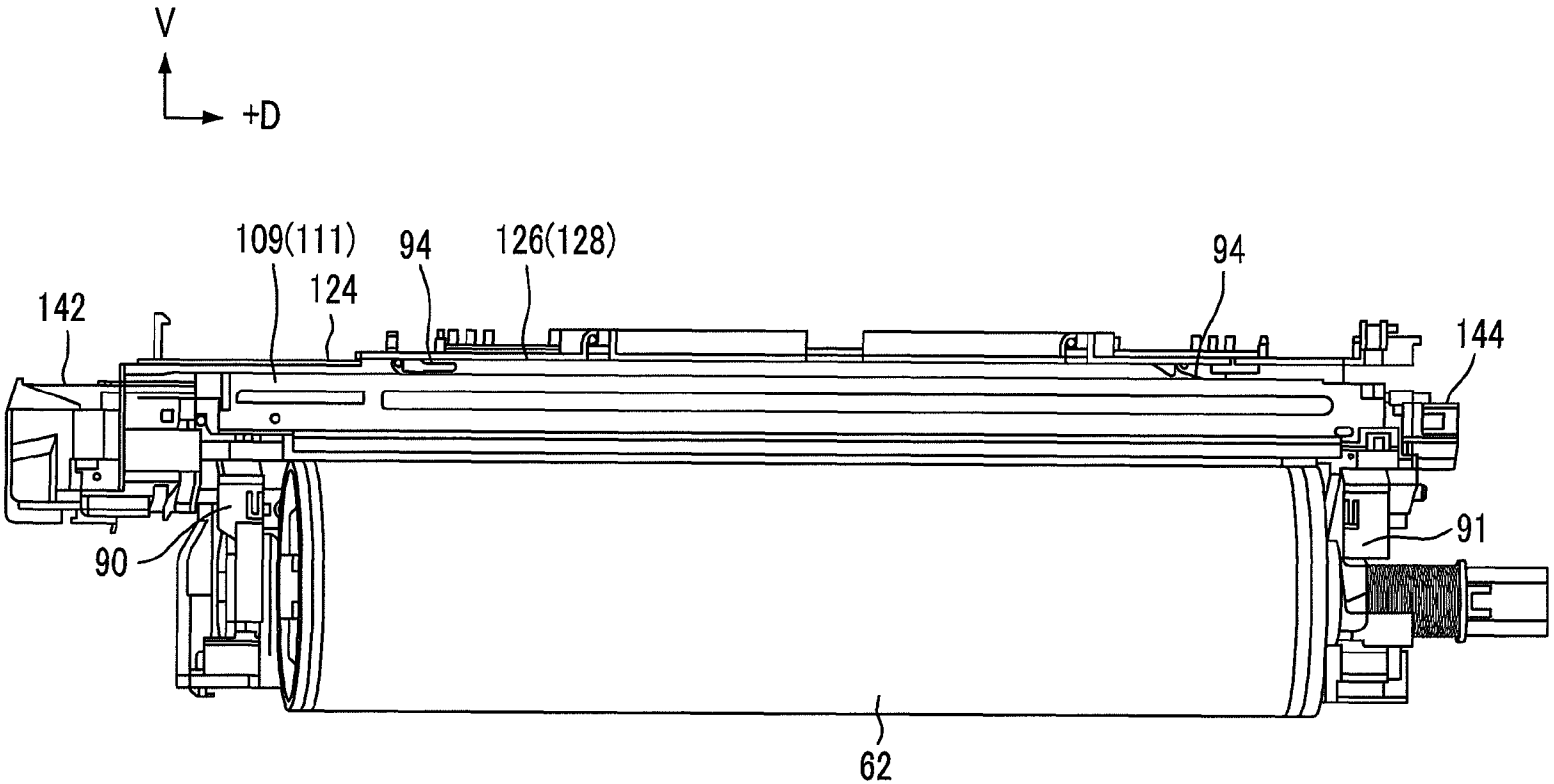
FIG. 6 is a front view illustrating a state where the photoreceptor and the charging unit according to the exemplary embodiment of the invention are disposed.

As shown in FIG. 6, spring members 94 (an example of the pinching member) which bias the charging unit 100 toward the photoreceptor 62 are disposed at the position where the outer circumferential surface of the photoreceptor 62 maybe charged between the slide members 126 and 128 which hold the charging unit 100, and the guide rails 109 and 111 constituting the charging unit 100. The spring members 94 use torsion springs or compression springs, and are disposed at two places corresponding to the ribs 90A and 91A which are respectively formed at the housings 90 and 91 supporting the photoreceptor 62.

Figure 7:
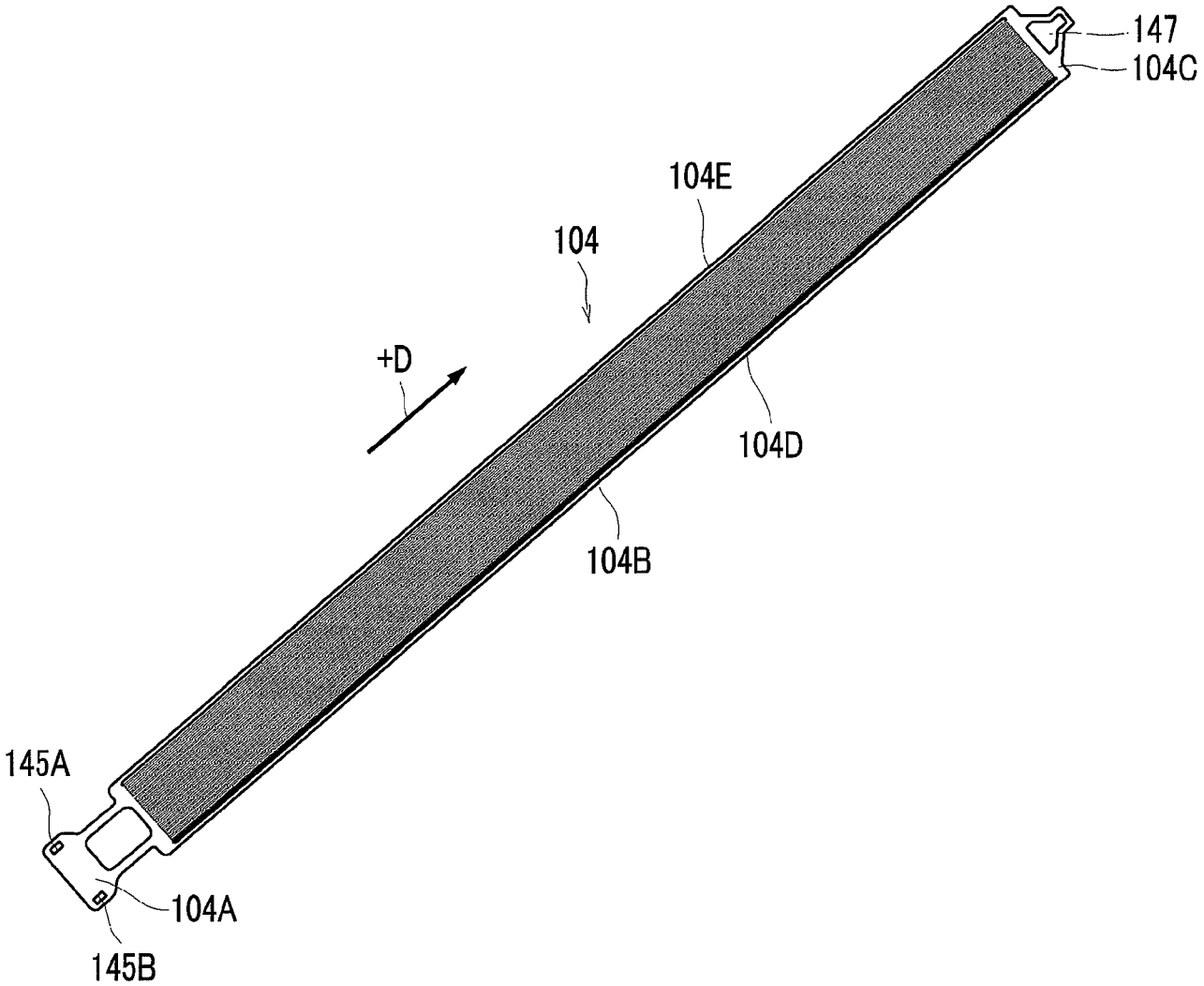
FIG. 7 is a perspective view illustrating a shape of the grid electrode according to the exemplary embodiment of the invention.
Figure 8:
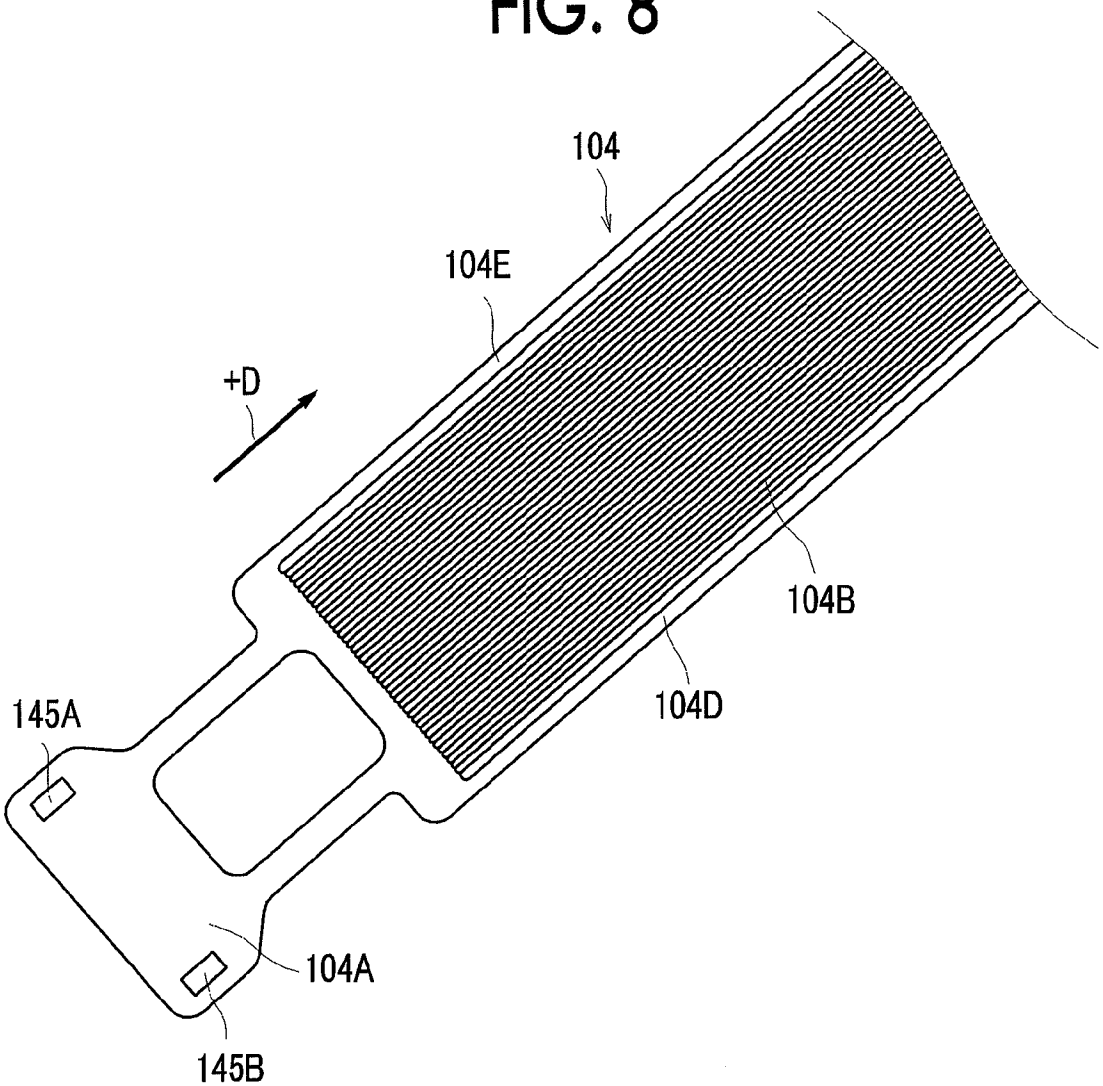
FIG. 8 is a perspective view illustrating a shape of one end of the grid electrode in the longitudinal direction according to the exemplary embodiment of the invention.
Figure 9:
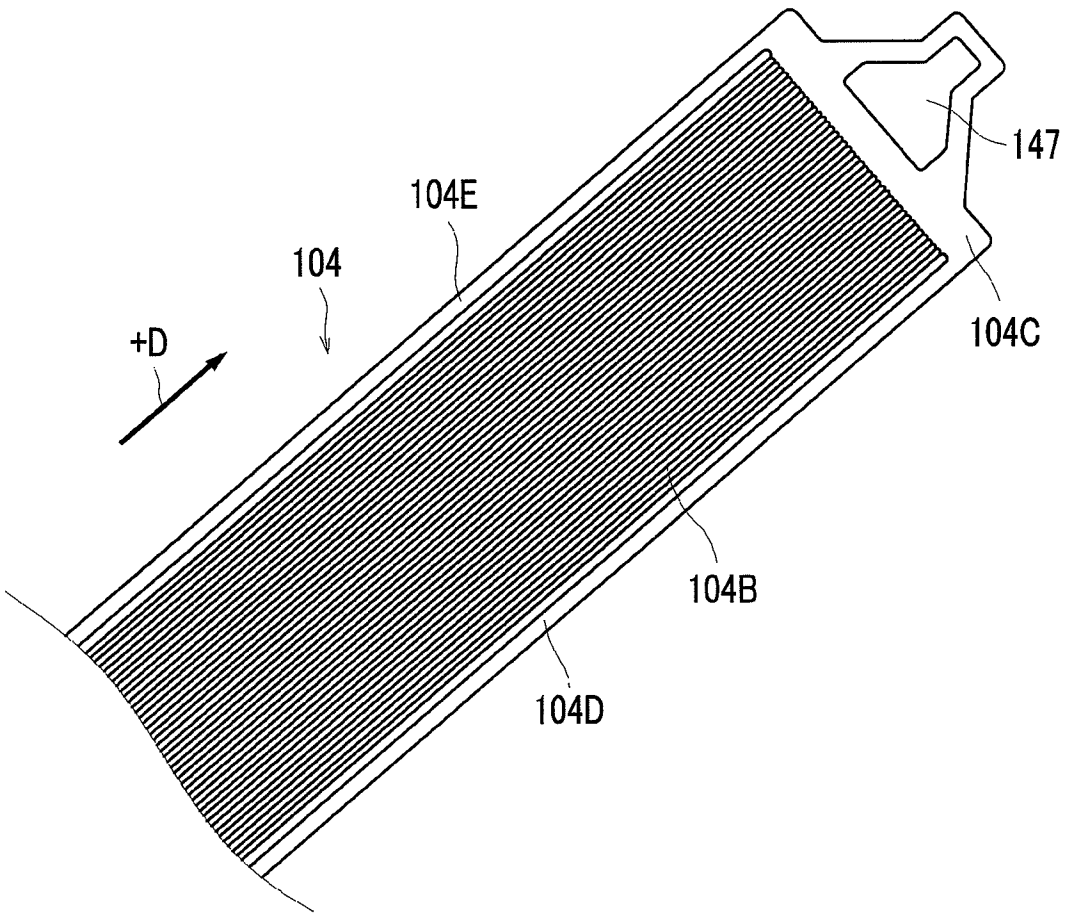
FIG. 9 is a perspective view illustrating a shape of the other end of the grid electrode in the longitudinal direction according to the exemplary embodiment.

As shown in FIGS. 7 to 9, the grid electrode 104 has a rectangular shape in plan view, and an installation portion 104A, an electrode portion 104B, and an installation portion 104C are integrally formed from one end to the other end in the longitudinal direction.

In addition, the grid electrode 104 is curved in a state of being installed in the charging unit 100 when viewed from the cross-section in the width direction. That is to say, in the grid electrode 104, the installation portion 104A, the electrode portion 104B, and the installation portion 104C are bent so as to form a convex shape toward the charge wires 102A and 102B (refer to FIG. 3). In addition, the curvature of the installation portion 104A, the electrode portion 104B, and the installation portion 104C is set such that the gap d with the outer circumferential surface of the photoreceptor 62 is the same as the circumferential direction of the photoreceptor 62, that is, they are curved along the outer circumferential surface of the photoreceptor 62.

The electrode portion 104B of the grid electrode 104 has a mesh shape which is formed of plural hexagonal holes (not shown), and, in order to increase stiffness, the frames 104D and 104E are respectively provided at both ends in the width direction. In addition, the electrode portion 104B is surrounded by the frame 104D, the installation portion 104A, the frame 104E, and the installation portion 104C.

As shown in FIGS. 7 and 8, the installation portion 104A of the grid electrode 104 is provided with installation holes 145A and 145B which are through-holes penetrated in the thickness direction. The installation holes 145A and 145B are respectively formed to have a rectangular shape at one end of the grid electrode 104 at intervals in the width direction.

In addition, as shown in FIGS. 7 and 9, in the installation portion 104C, an installation hole 147 which is a through-hole penetrated in the thickness direction is formed to have a substantially triangular shape at the other end of the grid electrode 104.

Figure 10:
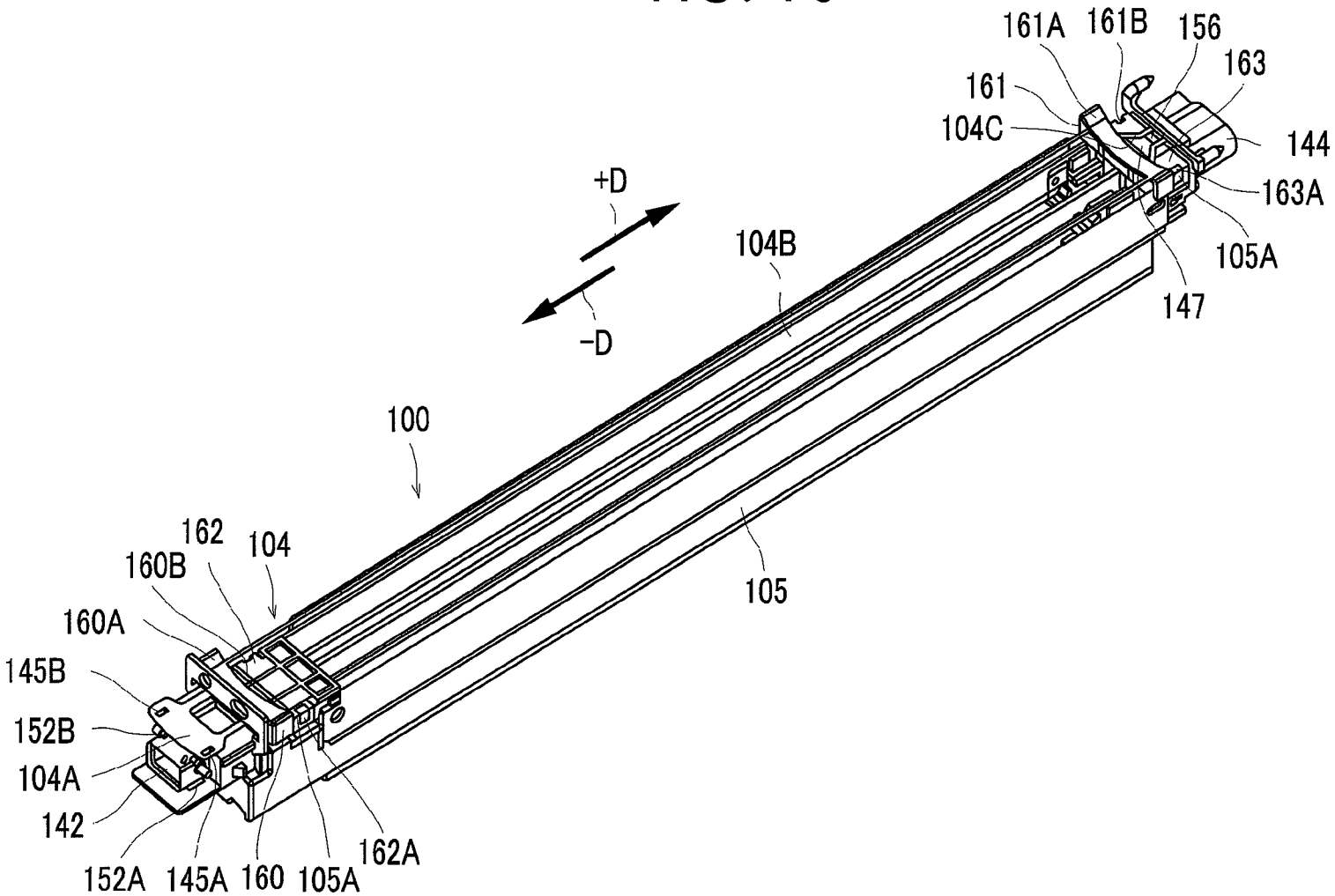
FIG. 10 is a perspective view illustrating the charging unit according to the exemplary embodiment of the invention.

As shown in FIG. 10, the installation member 142 is provided with spring members 152A and 152B which bias the grid electrode 104 in the arrow −D direction. The spring members 152A and 152B use, for example, torsion springs, and the first ends thereof are fixed to the installation member 142, and the second ends thereof are hooked to the edges of the installation holes 145A and 145B formed at one end of the grid electrode 104 in the longitudinal direction.

On the other hand, a hook portion 156 for fixing the other end of the grid electrode 104 in the longitudinal direction is provided at the bottom of the installation member 144. The hook portion 156 is bent in the arrow +D direction, and is hooked to the front end of the installation hole 147 of the grid electrode 104.

In addition, the spring members 152A and 152B are hooked to the installation holes 145A and 145B of the grid electrode 104; the hook portion 156 is hooked to the installation hole 147 by pulling the grid electrode 104 in the arrow +D direction; and thereby the grid electrode 104 is installed in the charging unit 100.

In FIG. 10, the installation members 142 and 144 installed in the charging unit 100 are provided with supporting surfaces 160A and 161A for supporting the grid electrode 104, and supporting bodies 160 and 161 (an example of the second supporting portion) having a function of covering the inside of the shield member 105. The supporting surfaces 160A and 161A are curved so as to be concave downwardly, and support both the sides of the grid electrode 104 in the longitudinal direction from the charge wires 102A and 102B side. Therefore, the grid electrode 104 is curved so as to form a concentric circle with the photoreceptor 62 along the shapes of the supporting surfaces 160A and 161A.

Here, the supporting bodies 160 and 161 are formed at the positions opposite to the ribs 90A and 91A formed on the above-described housings 90 and 91. In addition, since the ribs 90A and 91A support the curved grid electrode 104 from the photoreceptor 62 side, and the supporting bodies 160 and 161 support the curved grid electrode 104 from the charge wires 102A and 102B side, when the guide rails 109 and 111 provided in the charging unit 100 are moved downward by the movement of the slide members 126 and 128, and thereby the outer circumferential surface of the photoreceptor 62 reaches the position where it may be charged, the ribs 90A and 91B and the supporting bodies 160 and 161 approach each other via the grid electrode 104.

In addition, since the spring members 94 which bias the charging unit 100 toward the photoreceptor 62 are disposed between the slide members 126 and 128 and the guide rails 109 and 111, the grid electrode 104 is pinched by the ribs 90A and 91A and the supporting bodies 160 and 161 (FIG. 11).

The supporting bodies 160 and 161 are fixed to the shield member 105 via fixing members 162 and 163 provided with engagement holes 162A and 163A engaged into lock claws 105A which straddle the supporting bodies 160 and 161 in the width direction and are formed at the shield member 105. Therefore, the force which presses the supporting bodies 160 and 161 to the shield member 105 is generated by the fixing members 162 and 163, and thereby the supporting bodies 160 and 161 may be assembled into the shield member 105 without a gap.

The supporting bodies 160 and 161 have fixed surfaces 160B and 161B which are formed on the shield member 105 to be closer than the supporting surfaces 160A and 161A with the step difference (that is, the fixed surfaces 160B and 161B are more concave upwardly than the supporting surfaces 160A and 161A when viewed from the lower side). In addition, since the fixing members 162 and 163 fix the supporting bodies 160 and 161 to the fixed surfaces 160B and 161B, interference between the fixing members 162 and 163 and the grid electrode 104 is prevented. Further, the above-described hook portion 156, formed at the fixing member 163, protrudes downwardly, and is hooked to the front end of the installation hole 147 of the grid electrode 104 at a position which is the same as the supporting surface 161A or at a position which is closer to the shield member 105 than the supporting surface 161A.

Here, the spring members 152A and 152B which use torsion springs for giving tension to the grid electrode 104 are hooked to one end of the grid electrode 104 in the longitudinal direction. For this reason, the direction where the torsional force of the spring members 152A and 152B acts is a direction where the supporting body 160 is pressed to the shield member 105 via the grid electrode 104. Thereby, one end of the curved grid electrode 104 in the longitudinal direction is pressed to the supporting surface 160A of the supporting body 160, and the supporting body 160 comes into close contact with the shield member 105.

In addition, the hook portion 156 which is an example of the second pressing member formed at the fixing member 163 is, as described above, hooked to the front end of the installation hole 147 of the grid electrode 104 at a position which is the same as the supporting surface 161A or at a position which is closer to the shield member 105 than the supporting surface 161A. Thereby, the other end of the curved grid electrode 104 in the longitudinal direction is pressed to the supporting surface 161A of the supporting body 161. In addition, since the fixing member 163 (the hook portion 156 formed therein) is hooked to one end of the grid electrode 104, the tension applied to the grid electrode 104 is used as force which presses the supporting body 161 to the shield member 105.

Next, an operation of the exemplary embodiment will be described. During printing, as shown in FIGS. 5A and 5B, the control portion 20 (refer to FIG. 1) drives the motor 132 such that the slide members 126 and 128 are moved in the arrow −D direction and the guide rails 109 and 111 are moved downward. Thereby, as shown in FIG. 11, the charging unit 100 is located at the position where the charging unit 100 may charge the outer circumferential surface of the photoreceptor 62.

At this time, the ribs 90A and 91A formed in the housings 90 and 91 supporting the photoreceptor 62 of the latent image forming portion support the grid electrode 104 from the photoreceptor 62 side, and the supporting bodies 160 and 161 formed in the installation members 142 and 144 of the charging unit 100 support the grid electrode 104 from the charge wires 102A and 102B side, thereby maintaining the grid electrode 104 to be curved. In addition, since the spring member 94 which biases the charging unit 100 toward the photoreceptor 62 is disposed between the slide members 126 and 128 and the guide rails 109 and 111, as shown in FIG. 11, when the charging unit 100 is located at the position where the outer circumferential surface of the photoreceptor 62 may be charged, the grid electrode 104 is pinched by the ribs 90A and 91A and the supporting bodies 160 and 161 (the supporting surfaces 160A and 161A thereof).

In addition, when the grid electrode 104 is supported by the ribs 90A and 91A, the heights of the ribs 90A and 91A are set such that the grid electrode 104 and the photoreceptor 62 form the defined gap d (FIG. 11).

With this, the curved grid electrode 104 is pinched by the ribs 90A and 91A and the supporting bodies 160 and 161 and is restricted so as to maintain the curved shape, and thus a position thereof is determined with high accuracy such that the distance from the photoreceptor 62 is the gap d.

Further, since the spring members 94 are disposed at two places corresponding to the ribs 90A and 91A, balance between the force where the rib 90A and the supporting body 160 pinch the grid electrode 104 and the force where the rib 91A and the supporting body 161 pinch the grid electrode 104 becomes favorable. Therefore, the grid electrode 104 is reliably pinched by the ribs 90A and 91A and the supporting bodies 160 and 161.

Here, in a case where the grid electrode is a flat plate, instead of pinching it using two sets of members (here, the ribs 90A and 91A and the supporting bodies 160 and 161) as in the exemplary embodiment, if the grid electrode formed in the charging unit 100 is pressed to the members (here, the ribs 90A and 91A having flat upper surfaces) formed in the latent image forming portion, a position of the grid electrode may be determined with high accuracy using the tension of the grid electrode.

However, in a case where the grid electrode is curved as in the exemplary embodiment, if this structure is employed, the curved shape of the grid electrode is destroyed although the upper surfaces of the ribs 90A and 91A are formed to be curved along the grid electrode since the grid electrode is pressed by the members (here, the ribs 90A and 91A) formed in the latent image forming portion.

Therefore, as described above, the grid electrode 104 is pinched by the ribs 90A and 91A and the supporting bodies 160 and 161.

As above, although the invention made by the present inventor has been described in detail based on the exemplary embodiment, it is to be understood that the exemplary embodiment disclosed in the specification is only an example, and the invention is not limited to the disclosed techniques. That is to say, it is natural that the technical scope of the present invention is not construed as being limited based on the description in the exemplary embodiment but is construed according to the recitation of the claims, and it includes techniques equivalent to the techniques recited in the claims and all the modifications that fall within the spirit of the claims.

For example, the upper end surfaces of the ribs 90A and 91A or the lower end surfaces of the supporting bodies 160 and 161 are not necessarily curved continuously, but may be curved totally by intermittent protrusions.

The image forming apparatus according to the exemplary embodiment of the invention may select recording types freely, and, maybe applied to various image forming apparatuses which perform recording using toner such as, for example, a tandem type image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming portion that includes a latent image carrier having a cylindrical shape, and a supporting member disposed at both ends of the latent image carrier and rotatably supporting the latent image carrier;

a charging unit that includes a discharge electrode supplying electric charge to the latent image carrier due to discharge, and a grid electrode disposed between the discharge electrode and the latent image carrier, having a shape curved around the latent image carrier, and controlling a potential of the latent image carrier, and that charges an outer circumferential surface of the latent image carrier with a preset potential;

a first supporting portion that is disposed further on outside than the supporting member and supports the curved grid electrode from the latent image carrier side;

a second supporting portion that is provided at positions opposite to the first supporting portion in the charging unit and supports the curved grid electrode from the discharge electrode side; and a pinching unit that biases the charging unit toward the latent image forming portion so as to pinch the grid electrode between the first supporting portion and the second supporting portion in a contact state.

2. The image forming apparatus according to claim 1, wherein the pinching unit has at least two spring members that are disposed at places corresponding to the first supporting portion between a holding member holding the charging unit, and the charging unit, so as to press the second supporting portion toward the grid electrode.

3. The image forming apparatus according to claim 1, wherein the supporting member comprises two supports, one support disposed at one end of the latent image carrier and the other support disposed at the other end of the latent image carrier to rotatably support the latent image carrier.

4. The image forming apparatus according to claim 1, wherein the discharge electrode comprises two charge wires.

5. The image forming apparatus according to claim 1, wherein the first supporting portion comprises two ribs.

6. The image forming apparatus according to claim 5, wherein each of the ribs are curved to form a convex such that a center of curvature of the rib is common to the rotation center of the latent image carrier.

7. The image forming apparatus according to claim 5, wherein the second supporting portion comprises two supporting bodies disposed to correspond to respective ones of the two ribs, wherein the grid electrode is disposed between and contacts the two supporting bodies and the two ribs.

8. The image forming apparatus according to claim 1, wherein the second supporting portion comprises two supporting bodies.

* * * * *